US007654045B2

(12) United States Patent
Wiegel

(10) Patent No.: US 7,654,045 B2
(45) Date of Patent: Feb. 2, 2010

(54) WEATHER PROTECTION BARRIER FOR A FRANGIBLE OPENING OF A BUILDING

(75) Inventor: J. Parr Wiegel, Palmyra, NY (US)

(73) Assignee: StormBlok Systems, Inc., Palmyra, NY (US)

( * ) Notice: Subject to any disclaimer, the term of this patent is extended or adjusted under 35 U.S.C. 154(b) by 0 days.

(21) Appl. No.: 12/053,574

(22) Filed: Mar. 22, 2008

(65) Prior Publication Data

US 2009/0236058 A1 Sep. 24, 2009

(51) Int. Cl.

| | |
|---|---|
| ***E06B 3/26*** | (2006.01) |
| ***E06B 3/30*** | (2006.01) |
| ***E04B 1/00*** | (2006.01) |
| ***E04H 15/00*** | (2006.01) |

(52) U.S. Cl. ..... 52/202; 52/222; 52/63; 160/372; 160/352

(58) Field of Classification Search ..... 52/202, 52/203, 63, 222, 1; 160/371, 372, 374, 352, 160/90; 135/158, 159, 160, 100, 128
See application file for complete search history.

(56) References Cited

U.S. PATENT DOCUMENTS

| | | | | | |
|---|---|---|---|---|---|
| 247,606 | A | * | 9/1881 | Brown | 160/374 |
| 789,982 | A | | 5/1905 | Lockett | |
| 1,087,490 | A | * | 2/1914 | Henry | 52/63 |
| 1,327,427 | A | | 1/1920 | Foster | |
| 1,599,213 | A | * | 9/1926 | Coupal | 135/100 |
| 1,699,094 | A | * | 1/1929 | Chadirjian et al. | 135/100 |
| 1,755,866 | A | * | 4/1930 | Buxbaum | 160/210 |
| 1,850,380 | A | * | 3/1932 | Carpenter | 135/149 |
| 1,880,835 | A | | 10/1932 | Crickmer | |
| 2,598,940 | A | | 6/1952 | Robie | |
| 2,608,198 | A | | 8/1952 | Goodman | |
| 2,736,375 | A | * | 2/1956 | Rupert | 160/352 |
| 2,771,643 | A | * | 11/1956 | Zelov | 52/750 |
| 2,778,071 | A | * | 1/1957 | Anderson | 52/74 |
| 2,798,508 | A | | 7/1957 | Kahn | |
| 2,818,875 | A | * | 1/1958 | Denn | 135/159 |
| 2,822,586 | A | * | 2/1958 | McNeil | 52/74 |

(Continued)

OTHER PUBLICATIONS

Wiegel, J. Parr, Protective Flame Resistant Storm Shield for Reducing Wind Damage, Abandoned Patent Application, Apr. 9, 2004; U.S. Appl. No. 10/822,161.

(Continued)

*Primary Examiner*—Robert J Canfield
*Assistant Examiner*—Babajide Demuren
(74) *Attorney, Agent, or Firm*—Jodi A. Reynolds, Esq.; Brian B. Shaw, Esq.; Harter Secrest & Emery LLP

(57) ABSTRACT

A weather barrier is provided for a frangible element such as a window having an outer perimeter, the frame including a plurality of struts defining a converging end and a diverging end of the frame, the diverging end having a given periphery, a plurality of brackets disposed about the outer perimeter of the frangible element, the diverging end of the frame engageable with the brackets to space the converging end spaced from the window, the given periphery of the diverging end corresponding to the outer perimeter of the window, and a flexible material encapsulating the frame to define an enclosed volume.

18 Claims, 7 Drawing Sheets

U.S. PATENT DOCUMENTS 2,828,757 A * 4/1958 Thaxton, Jr. ..... 135/97
3,021,894 A 2/1962 La Due
3,021,897 A * 2/1962 Ford ..... 160/114
3,064,550 A 11/1962 O'Day et al.
3,149,381 A 9/1964 Santo
3,354,809 A * 11/1967 Orr et al. ..... 454/202
3,484,994 A 12/1969 Ashby
3,691,703 A 9/1972 Barnes
3,698,143 A * 10/1972 Francis ..... 52/29
3,760,541 A * 9/1973 Fulcher ..... 52/203
3,777,136 A 12/1973 Okuda
3,812,616 A * 5/1974 Koziol ..... 52/63
3,828,455 A 8/1974 Bentley
3,848,367 A 11/1974 Barnes
3,947,985 A 4/1976 Skrzypczak
3,949,527 A 4/1976 Double et al.
4,000,585 A * 1/1977 Denaro ..... 52/2.17
4,144,900 A 3/1979 Kinski
4,196,880 A * 4/1980 Hynes ..... 248/99
4,222,400 A * 9/1980 Reimer ..... 135/88.16
4,224,770 A * 9/1980 Petty ..... 52/82
4,605,030 A 8/1986 Johnson
4,655,236 A 4/1987 Dorame
4,702,478 A * 10/1987 Kruse ..... 273/127 B
4,726,149 A 2/1988 Tryba
4,727,898 A 3/1988 Guma
4,766,918 A * 8/1988 Odekirk ..... 52/2.23
4,837,974 A 6/1989 Jokel
4,842,323 A 6/1989 Trickett
4,848,386 A * 7/1989 Cooper ..... 135/90
4,887,543 A 12/1989 Rockhill
4,890,839 A * 1/1990 Ayotte ..... 273/157 R
4,944,321 A 7/1990 Moyet-Ortiz
4,974,621 A * 12/1990 Lerma ..... 135/139
4,991,363 A 2/1991 Randmae
4,998,381 A 3/1991 Langenhorst
5,072,694 A * 12/1991 Haynes et al. ..... 119/482
5,084,994 A 2/1992 Elmer
5,158,103 A 10/1992 Leu
5,176,421 A 1/1993 Fasiska
5,197,239 A 3/1993 Glynn et al.
5,201,152 A 4/1993 Heffner
5,255,698 A * 10/1993 Riley ..... 135/142
5,375,354 A 12/1994 Rutledge
5,522,165 A 6/1996 Molla
5,579,794 A * 12/1996 Sporta ..... 135/88.01
5,595,233 A * 1/1997 Gower ..... 160/232
5,685,112 A 11/1997 Fara
5,740,826 A 4/1998 Nivin et al.
5,746,237 A 5/1998 Amic
5,791,090 A 8/1998 Gitlin et al.
5,857,477 A 1/1999 James
5,881,499 A 3/1999 Luzzi
5,918,430 A * 7/1999 Rowland ..... 52/202
5,983,573 A 11/1999 MacKarvich
6,088,975 A 7/2000 Wiegel
6,089,645 A 7/2000 Haddad, Jr.
6,092,857 A 7/2000 Rivas
6,095,230 A * 8/2000 Mitchell et al. ..... 160/370.21
6,109,680 A 8/2000 Horner et al.
6,116,256 A * 9/2000 Pawsey et al. ..... 135/147
6,176,050 B1 * 1/2001 Gower ..... 52/222
6,176,056 B1 1/2001 MacKarvich
6,206,448 B1 3/2001 Haddad, Jr.
6,220,263 B1 4/2001 Randmae
6,220,648 B1 4/2001 Daniel
6,276,381 B1 8/2001 O'Brien
6,325,085 B1 * 12/2001 Gower ..... 135/90
6,334,282 B1 1/2002 Wood
6,341,455 B1 * 1/2002 Gunn ..... 52/202
6,363,670 B1 4/2002 Dewitt
6,405,862 B1 6/2002 Allain et al.
6,502,709 B1 1/2003 Parker
6,513,858 B1 2/2003 Lie et al.
6,517,141 B1 2/2003 Su
6,550,189 B2 * 4/2003 Shelton ..... 52/167.1
6,615,555 B2 9/2003 Madden
6,631,749 B1 10/2003 Zambala
6,637,800 B2 10/2003 Henning
6,659,531 B2 12/2003 Searfoss
6,672,643 B1 1/2004 Brodsky et al.
6,682,123 B2 1/2004 Burks et al.
6,705,664 B1 3/2004 Lahutsky
6,745,522 B2 6/2004 Germain
6,865,852 B2 * 3/2005 Gower ..... 52/222
6,893,074 B1 5/2005 Wilson
6,904,923 B2 * 6/2005 Chai et al. ..... 135/88.09
6,938,881 B2 9/2005 Grapes
6,964,446 B2 11/2005 Porter
7,036,867 B1 5/2006 Yang
7,131,480 B2 11/2006 Briscoe et al.
7,240,944 B2 7/2007 Plettrichs et al.
7,281,752 B2 10/2007 Wiegel et al.
7,337,582 B1 3/2008 Klotz
2002/0157696 A1 10/2002 O'Brien
2004/0107619 A1 6/2004 Perelli et al.
2006/0086057 A1 * 4/2006 Rasenberger et al. ..... 52/202
2006/0174929 A1 * 8/2006 Tseng ..... 135/159
2006/0175131 A1 * 8/2006 Smith ..... 182/129
2007/0204533 A1 * 9/2007 Gower ..... 52/202

OTHER PUBLICATIONS

Wiegel, J. Parr, Vehicle Protection System and Method of Making Same, Pending Patent Application, Filed Jan. Jan. 18, 2008; U.S. Appl. No. 12/016,520.

Wiegle, J. Parr, Portable Vehicle and/or Equipment Storm Shield, Pending Patent Application, Filed Oct. 11, 2007; U.S. Appl. No. 11/870,954.

Wiegel, J. Parr, Weather Protection System for Signage, Pending Patent Application, Filed Mar. 7, 2007; U.S. Appl. No. 11/690,710.

Hurricanes and Related Deaths in the United States, Facts and Statistics, Insurance Information Institution, http://www.iii.org/media/facts/statsbyissue/hurricances/.

* cited by examiner

WEATHER PROTECTION BARRIER FOR A FRANGIBLE OPENING OF A BUILDING

CROSS-REFERENCE TO RELATED APPLICATIONS

None.

FIELD OF THE INVENTION

The present invention relates generally to weather protection devices for buildings, and more particularly to a weather barrier for frangible portions of a building, such as windows and doors within an opening frame, wherein the barrier reduces impact damage and reduces a wind drag coefficient.

BACKGROUND OF THE INVENTION

Severe weather such as tropical storms, hail, tornadoes, wildfires, and hurricanes has recently destroyed thousands of businesses and homes. Hurricanes are particularly problematic as multiple storms develop each season, and the torrential rains and heavy winds of each storm launch windborne objects that damage homes, vehicles and other property. According to the Insurance Information Institute, insurance companies paid approximately $40.6 billion from damage cause by Hurricane Katrina of August 2005 alone. Further, over three million claims were made in 2005 for personal property loss, which excludes vehicles.

Since these types of natural disasters occur repeatedly, insurance companies in states prone to severe weather are unsuccessful in maintaining a profit and being self-sustaining. Therefore, property owners suffer catastrophic losses which cannot be fully recovered from insurance companies. Thus, it is most desirable to protect personal and real property from damage during severe weather.

The conventional method for protecting personal and real property in severe weather is to cover the property with a tarp and to place plywood over windows, doors and other openings. While this method is inexpensive, it is also ineffective. Frangible openings in buildings, such as windows and doors usually succumb to the force of hurricanes wherein the glass cracks, break or even burst from windborne debris and changes in air pressure.

What is needed then is a method and apparatus for temporarily encapsulating a frangible element in an opening in a building so as to protect the building from severe weather.

It would, therefore, be desirable to provide a weather protection device that overcomes the aforesaid and other disadvantages.

SUMMARY OF THE INVENTION

In one configuration, the weather protection device comprises a weather barrier for an opening frame including a frangible element such as a window having an outer perimeter and a surface for allowing light to pass comprising a plurality of struts forming a frame having a converging end and a diverging end, the diverging end having a given periphery. A plurality of brackets is disposed about the outer perimeter of the window, and the diverging end of the frame is engageable with the brackets to space the converging end spaced from the window. The given periphery of the diverging end corresponds to the outer perimeter of the window and a flexible material encapsulates the frame to define an enclosed volume.

In another configuration, a barrier for protecting a frangible portion of a building is provided wherein the barrier includes a plurality of brackets disposed along a periphery of the frangible portion of the building. A plurality of mounts is disposed along a periphery of the frangible portion of the building. The barrier further includes a frame, including at least four struts each having a converging end and a diverging end, the converging end distal from the frangible portion of the building and the diverging end coupled to one of the plurality of brackets, and a flexible material having fasteners along an outer circumference of the flexible material, wherein the fasteners are coupled to the plurality of mounts.

In a further configuration, a method of isolating a frangible portion of a building from weather is provided by attaching brackets each having a first protruding end along a perimeter of the frangible portion of the building, coupling hollow poles to each of the first protruding ends of the brackets, coupling a diverging end of a pyramidal frame and two substantially perpendicular struts to each of the hollow poles, adjustably connecting one of the two substantially perpendicular struts coupled to one of the brackets to one of the two substantially perpendicular struts coupled to another one of the brackets, and fastening a flexible material to the building to enclose the frangible portion.

BRIEF DESCRIPTION OF THE DRAWING FIGURES

The foregoing features of this invention, as well as the invention itself, may be more fully understood from the following description of the drawings in which.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiment, it is understood that the invention is not limited to the disclosed embodiment.

Furthermore, it is understood that the invention is not limited to the particular methodology, materials, and modifications described and as such may vary. It is also understood that the terminology used herein is for the purpose of describing particular elements only, and is not intended to limit the scope of the present invention, which is limited only by the appended claims.

Figure 1:
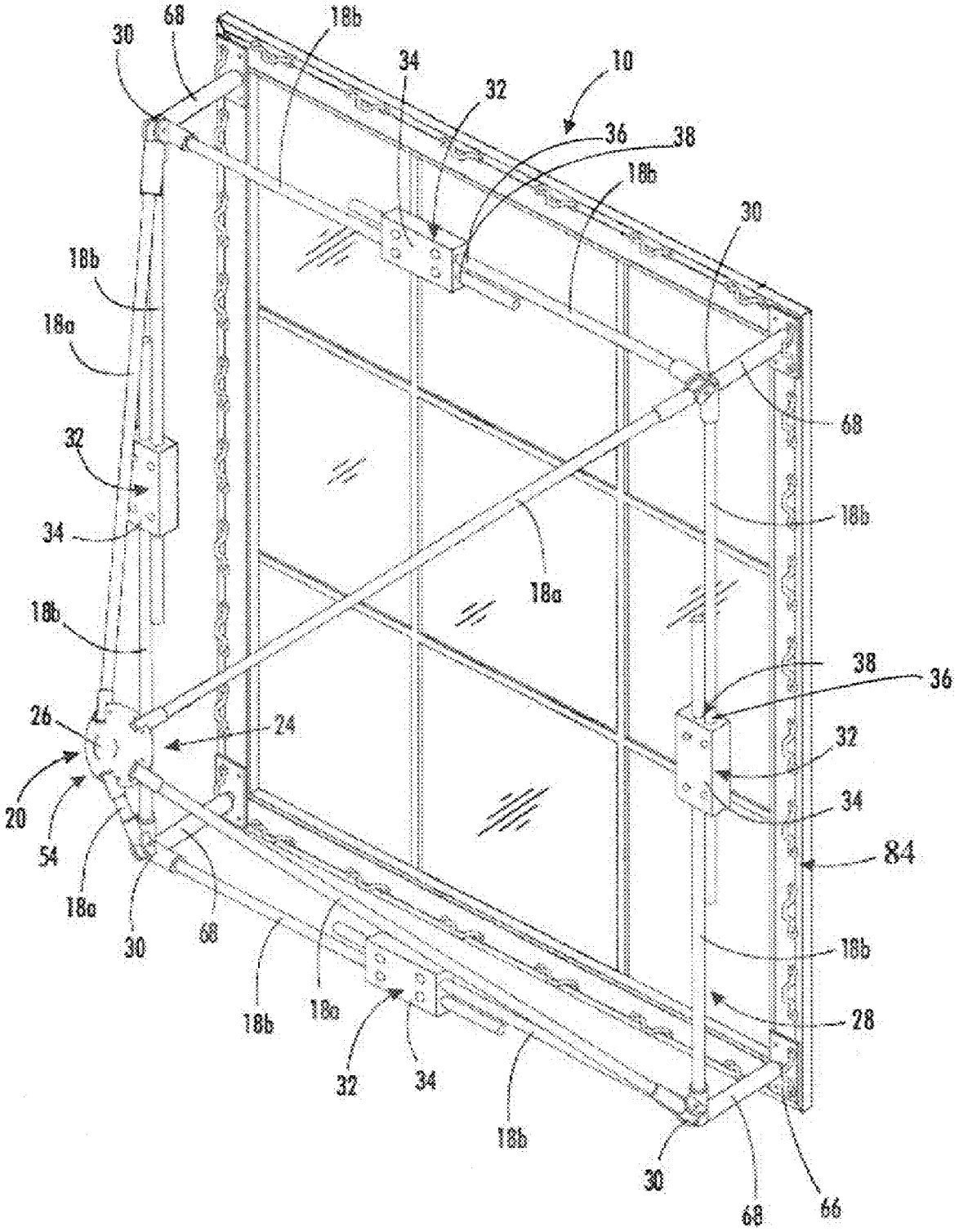
FIG. 1 is a perspective view of a frame secured to a window frame relative to a window.
Figure 2:
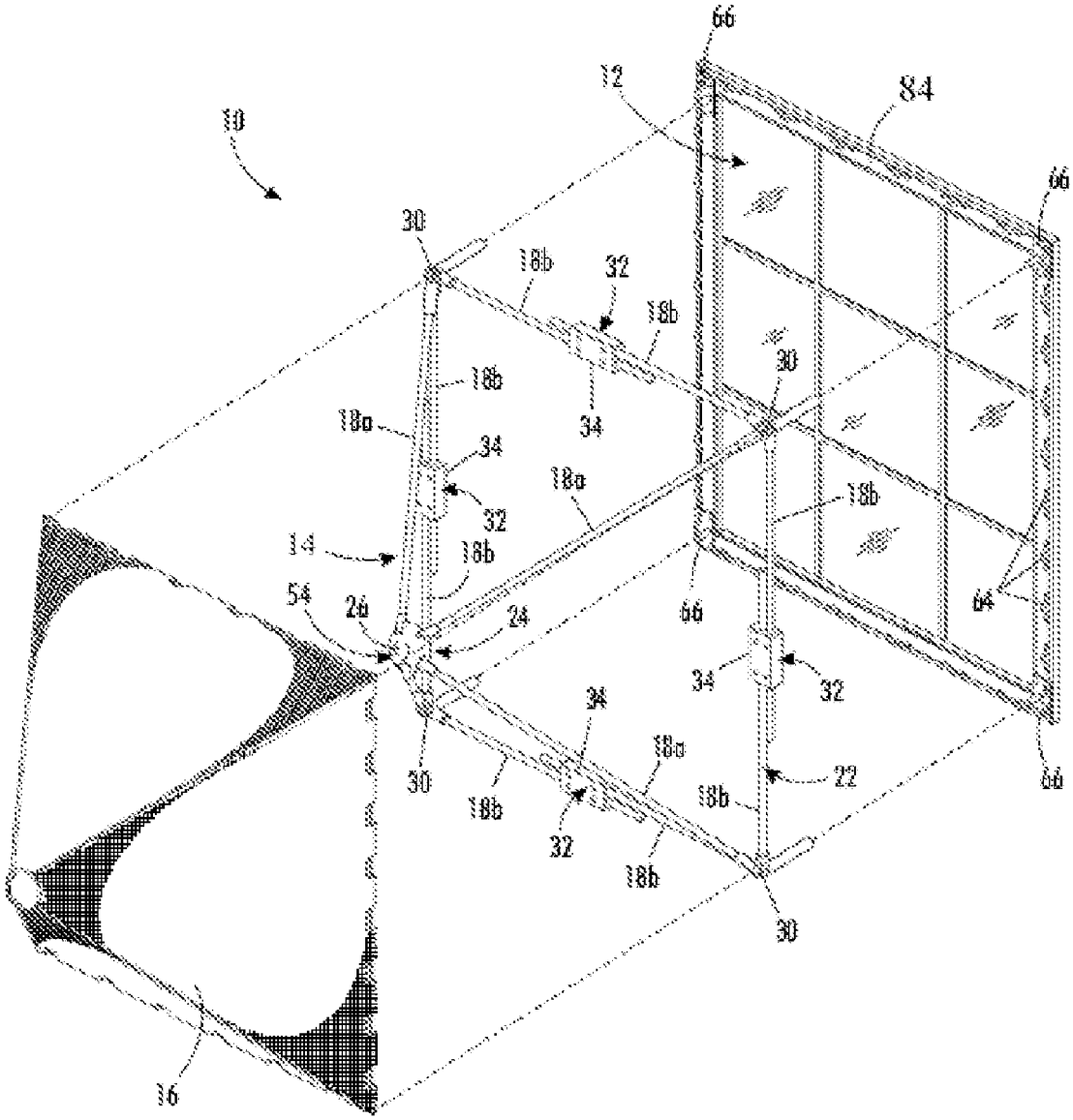
FIG. 2 is an exploded perspective view of the window barrier as shown in FIG. 1 and including a flexible material for securing thereto and partially enclosing a volume.

Referring now to the figures, FIGS. 1 and 2 show a weather barrier 10 for a window 12 within an opening frame 84. The window 12 is understood to include a frangible element such as glass, plastic or composite within the surrounding opening frame 84, such as a door frame or a window frame. The opening frame 84 is intended to encompass sashes, window frames, door frames, stops, or other structural members at least partially defining the opening, and to which a portion of the present barrier can be connected. Thus, as used herein, opening frame 84 encompasses the structure at least partially defining an opening into which the frangible element, such as a light transmissive window 12 is disposed. The opening frame 84 can be part of a window assembly, a door assembly or can be a part of the building itself. Although a standard double-hung window is shown in the accompanying drawings, it should be appreciated that most all window styles, shapes and sizes can be accommodated by the weather barrier 10. For example, the window barrier 10 can protect the following window types and sizes, which include but are not limited to: sliding windows, sometimes referred to as sliding windows, having a width ranging from approximately 35 inches to approximately 72 inches and a height ranging from approximately 22 inches to approximately 72 inches; double hung windows having a width ranging from approximately 22 inches to approximately 46 inches and a height ranging from approximately 37 inches to approximately 77 inches; casement windows having a width ranging from approximately 17 inches to approximately 85 inches and a height ranging from approximately 24 inches to approximately 72 inches; awning windows having a width ranging from approximately 24 inches to approximately 85 inches and a height ranging from approximately 17 inches to approximately 72 inches. Further, it should be appreciated that by window 12, it is meant any type of frangible element in an opening or portion of a building, wherein the frangible element is exposed to the ambient environment. Thus, the weather barrier 10 can be employed with ingress and egress doors, wherein the doors may include a frangible element such as the window 12, and can be of any size including, but limited to approximately 24 inches wide to 8 feet or more and from approximately 5 feet high to over 12 feet high.

The weather barrier 10 generally comprises a frame 14 coupled to the opening frame 84 and a flexible material 16 encapsulating the frame 14 to define an enclosed volume 90. The frame 14 includes a plurality of struts 18*a*, 18*b*, wherein the struts 18*a* form a substantially pyramidal-shaped enclosure 20 and the struts 18*b* for a substantially rectangular-shaped base 22. By substantially rectangular-shaped base 22, it is meant that the base 22 is any-type of parallelogram, typically with four right angles. It should be appreciated that the struts 18*a*, 18*b* can be made of any impact resistant material such as metal, fiberglass, stainless steel, aluminum, rubber, plastic, high durometer plastic, etc.

The frame 14 defines a converging end 24, wherein a flexible or pivoting joint or hinge 26 receives the struts 18*a*, and a diverging end 28 having a given periphery a, b, c, d which corresponds to the outer perimeter of the window 12 or the opening frame 84. When the frame 14 is coupled to the opening frame 84, the converging end 24 is spaced from the planar surface of the window 12 and the diverging end 28 is arranged proximal to the planar surface of the window 12 or the opening frame 84. The base 22 is coupled to the substantially pyramidal-shaped enclosure 20 at the diverging end 26 via connectors 30. The struts 18*b* of the base 22 are co-planar, have an adjustable length and define the given periphery a, b, c, d.

The struts 18*b* have an adjustable length and are coupled via connectors 32. Preferably, the struts 18*b* can be adjusted from a first non-extended position to a second extended position, to provide a 2 foot expansion of the frame 14. More preferably, the struts 18*b* are adjusted from a first non-extended position to a second extended position to provide a 1 foot expansion of the frame 14. Even more preferably, the struts are adjusted from a first non-extended position to a second extended position to provide a one-half (½) foot expansion of the frame 14, wherein the installer selects the appropriate size window barrier 10 according to a selection of standard size-manufactured window barriers 10.

The connectors 32 can be any type of mechanism that allows the struts 18*b* to be adjusted. In one configuration, as shown in FIGS. 1 and 2, the base 22 can include adjustable blocks 34 having two juxtaposed parallel through-bores 36, 38 for receiving terminal ends of the struts 18*b*. The through-bores 36, 38 can include a locking mechanism to secure the struts 18*b* in a desire position. For example, the locking mechanism can comprise collars abutting the each side of each through-bore 36, 38, compression rings tightened via a release lever, cotter pins, drive bolts, push button locking systems and other types of twist-lock mechanisms and these modifications are intended to be within the spirit and scope of the invention as claimed.

In another configuration, the struts 18*b* can also include threaded terminal ends not shown that are received by threaded openings or a ratchet system. In yet another configuration, the adjustable block 34 can include a spring biased cam actuated to engage notches along the terminal ends of the struts 18*b* or a cam having an eccentric disk that engages the terminal end of each of the struts 18*b* when actuated. One skilled in the art would appreciate that other mechanisms can be used to secure the struts 18*b* in the desired position.

In another configuration, each of the connectors 32 comprises sleeves for receiving two terminal ends of the struts 18*b*. The sleeves each include an external ring at the terminal ends of the sleeves, the external rings having a tapered portion or a threaded portion corresponding to a tapered portion or a threaded portion on the outer diameter of the sleeve. Alternatively, a pin and hole mechanism may be used to couple the sleeves to the terminal ends of the struts 18*b* allowing for incremental adjustments. A turn-buckle mechanism can also be used, wherein the terminal ends of the struts 18*b* are threaded in opposite directions, which correspond to a threaded portion of each terminal end of the sleeve.

At an apex 54 of the converging end 24, the flexible or articulated joint 26 couples the terminal ends of the struts 18*a* to form the substantially pyramidal-shaped enclosure 20. The joint 26 is moveable or adjustable to accommodate different angles of the struts relative to the joint, thereby causing the distance of the apex 54 from the planar surface of a window to decrease (or increase) and the given periphery a, b, c, d of the diverging end 28 to correspondingly increase (or decrease). Thus, when the when the base 22 is expanded, the angle of the struts relative to the joint 26 increases. Similarly, when the base 22 is retracted, thereby conforming to a smaller opening frame perimeter, the distance of the apex 54 to the planar surface of the window 12 (or the opening frame 84) increases and the given periphery a, b, c, d of the diverging end 28 decreases.

Figure 3:
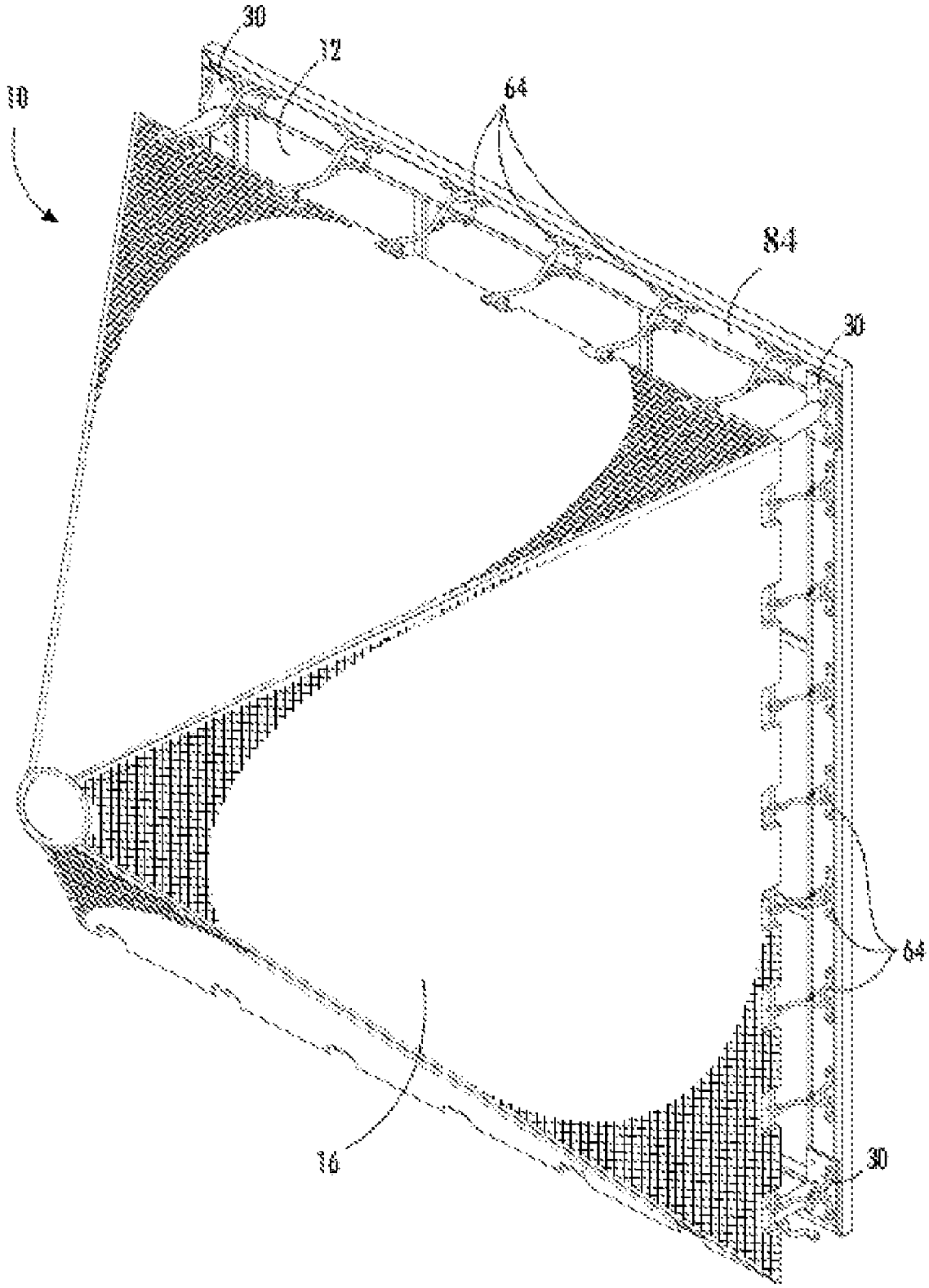
FIG. 3 is a perspective view of the window barrier showing the flexible material enclosing a portion of the frame.

At least the substantially pyramidal-shaped enclosure 20 is any aerodynamic shape that reduces a wind drag coefficient on the planar surface of the window 12 when a flexible material 16 is secured to the frame 14, as shown in FIG. 3 to enclose the pyramidal-shape. That is, the flexible material 16 is disposed about the enclosure 20 to cover the intersecting facets and the base 22. Thus, an enclosed volume or chamber 90 is defined by the frame 14 and the encapsulating flexible material 16. Although the enclosure 20 is referred to herein as pyramidal-shaped, it should be appreciated by those having ordinary skill that the enclosure 20 can be triangular, pyramidal, octagonal pyramidal, cone shaped, triangular prism, etc.

Each of these constructions providing an angled surface to wind directed tangential to the plane of the window 12.

It should be appreciated by those having ordinary skill in the art that the "wind drag coefficient" or $C_d$ is the quantity that describes a characteristic amount of aerodynamic drag caused by wind, which is used in the drag equation:

$$F_d = \tfrac{1}{2} C_d \rho v^2 A$$

The drag force, $F_d$, is proportional to the drag coefficient number, $C_d$. Thus, reducing the drag force coefficient by adding the window barrier 10 can reduce the drag force. It should be appreciated that other dimensionless force and moment coefficients may be reduced as well. The window barrier 10 can be configured to reduce at least one of the following force and moment coefficients by at least 20%, preferably by at least 35% and more preferably by at least 50%:

$$C_n = \frac{N}{\frac{1}{2}\rho v^2 A} \text{ (Normal Force Coefficient)}$$

$$C_{ax} = \frac{A_x}{\frac{1}{2}\rho v^2 A} \text{ (Axial Force Coefficient)}$$

$$C_s = \frac{S}{\frac{1}{2}\rho v^2 A} \text{ (Side Force Coefficient)}$$

$$C_{pm} = \frac{M_p}{\frac{1}{2}\rho v^2 AL} \text{ (Pitching Moment Coefficient)}$$

$$C_{rm} = \frac{M_r}{\frac{1}{2}\rho v^2 AL} \text{ (Rolling Moment Coefficient)}$$

$$C_{ym} = \frac{M_y}{\frac{1}{2}\rho v^2 AL} \text{ (Yawing Moment Coefficient)}$$

The flexible material 16 having at least some tensility is coupled to the frame 14 providing a barrier from hurricane force winds, heavy rains, and windborne debris. In one configuration, the flexible material 16 encloses the frame 14 (on all four sides for the geometry shown in FIGS. 1-3, thereby protecting the window 12. In one configuration, the flexible material 16 covers the facets of the frame 14 forming the pyramidal shape and the base of the enclosure 20, thereby forming a generally encapsulated or enclosed volume. In a preferred embodiment, the base 22 spaces the substantially pyramidal-shaped enclosure 20 at least approximately two inches, and in one configuration about four inches more preferably at least six inches, and most preferably at least eight inches from the planar surface of the window 12 (or the opening frame 84) as described in more detail supra. It should be appreciated that having the flexible material 16 pulled taut around the frame 14 and the base 22 of the frame 14. Although the flexible material 16 is set forth as enclosing the frame 14, it is understood the flexible material can be connected to the frame to be within the volume defined by the frame. However, such construction requires more fasteners connecting the flexible material to the frame. A peripheral skirt of the flexible material 16 can be formed to abut or be immediately adjacent to the opening frame 84, wherein the portion of the flexible material covering the base 22 can thus be spaced from the window 12, within the skirt.

In one configuration, the base 22 is spaced from the planar surface of the window 12 to allow the window barrier 10 to be impact resistant. Alternatively, the flexible material 16 could have an elastic characteristic that allows the material to change shape in response to debris striking the flexible material 16 and then return to its original form when the force is removed. Either the tensile strain or elasticity of the flexible material 16 will reduce the acceleration of windborne debris over a longer period of time and reduce the force of the impact according to Newton's second law of motion (F=ma). Therefore, the force of the debris impact will be reduced because it will have a longer time to decelerate. The flexible material 16 is a generally rip stop or tear resistant material such as a woven polymer including nylon or polyester, wherein the material exhibits an air permeability of approximately 0.5 to 30 $ft^3$ per minute (cfm), with a preferable permeability of approximately 6 to 21 cfm. It has been found a permeability less than 6 and greater than 24 cfm does function in the intended manner, as set forth below. The flexible material 16 also has a penetration resistance to a 12 foot long two by four impacting the material along the longitudinal dimension of the two by four at a velocity of 55 feet per second. The flexible material 16 can include a coating of urethane, wherein the coating retains the desired air permeability.

Additionally, the flexible material 16 coupled to the frame 14 can cause windborne debris to deflect off the window barrier 10 and therefore the debris causes less damage. That is, without the window barrier 10 on the window 12, a significant amount of wind and debris will strike the planar surface of the window 12 "straight-on" meaning at a line perpendicular to the planar surface of the window 12. The window barrier 10, however, will cause a significant amount of wind and debris to strike the surface of the barrier 10 at an "angle of incidence". That is, the wind and debris will be deflected at an angle from the line perpendicular to the planar surface of the window 12. This angle of incidence is a vector that can be resolved into a horizontal component and a perpendicular component. Having a greater angle of incidence increases the horizontal component magnitude and decreases the perpendicular component magnitude. Decreasing the perpendicular component magnitude will reduce the amount of force the window barrier 10 absorbs when struck by wind and debris and therefore the debris and wind will cause less damage.

Further, the spacing between the substantially pyramidal-shaped enclosure 20 and the planar surface of the window 12 allows the impact to be absorbed away from the window 12 leaving the window 12 unharmed from hurricane force winds, heavy rain, and debris.

Figure 4:
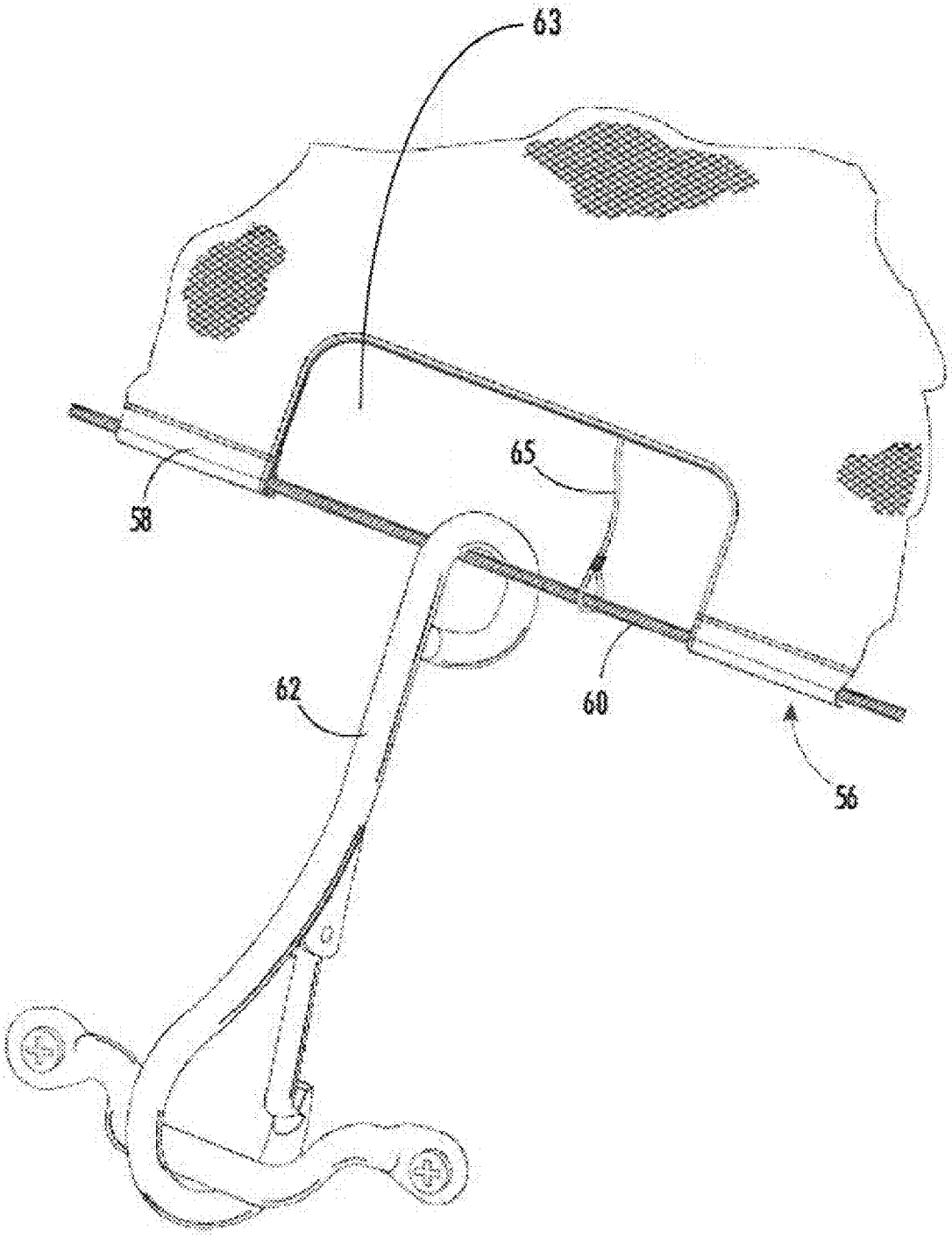
FIG. 4 is a section of the flexible material showing an opening along the hem exposing a cable and a clip.

As shown in FIGS. 3 and 4, the flexible material 16 includes a hem 56 along an outer circumference 58 of the flexible material 16 having a substantially inextensible cord or cable 60 embedded therein. Spaced along the outer circumference 58 are cut-out portions 63 providing a portion of exposed cable 60. A clip 62 is secured to each exposed cable 60. Each cut-out portion 63 is spaced to correspond to one of a plurality of u-shaped mounts 64 disposed along the perimeter of the window, such as along the window frame, allowing each clip 62 to engage one of the u-shaped mounts 64. It should be appreciated that any number of u-shaped mounts 64 may be used to secure the flexible material 16 to the window 12. In one embodiment, at least eight u-shaped mounts 64 are secured along each horizontal perimeter edge of the window 12 and at least ten u-shaped mounts 64 are secured along each vertical perimeter edge of the window 12. Other types of mounts 64 can be used, including but not limited to those made of high durometer plastic, rubber, stainless steel, aluminum, fiberglass, and other plastic materials and metals. The mounts 64 and clips are sized to disposed the flexible material adjacent to the window, or the window frame.

The flexible material 16 and the cable 60 are selected to dispose the cable adjacent to the opening frame 84, or the plane of the opening frame. In one configuration, the cable 60 (and hence edge of the flexible material 16) is within 8 inches, and preferably within 4 inches and more preferably within 2 inches, and more preferably within one inch of the opening frame 84 (or the plane of the opening frame). Alternatively, the flexible material 16 can be spaced from the opening frame 84, as seen in FIG. 3.

In one configuration, the mounts 64 are coated with a material that wears with use, for example, the mounts 64 may be painted. Thus, for purposes of insurance coverage and determining whether the window barrier 10 was used, an insurer can determine whether the window barrier was installed, before providing an insured claimant with a reimbursement for any window damage that purportedly occurred despite the use of the window barrier 10. In addition, a thread 65 can be looped around the cable 60 within each cut-out portion 63, wherein both thread ends are attached to the flexible material 16. The thread 65 is of a low tensile strength, such that the thread 65 breaks when the window barrier 10 is in use. The thread 65 has a lower tensile strength than the flexible material 16. A broken thread 65 indicates use of the system, thereby allowing an insurer to determine whether the window barrier 10 was actually installed before severe weather to ensure an insured claimant is entitled to a reimbursement for window damage.

Figure 5A:
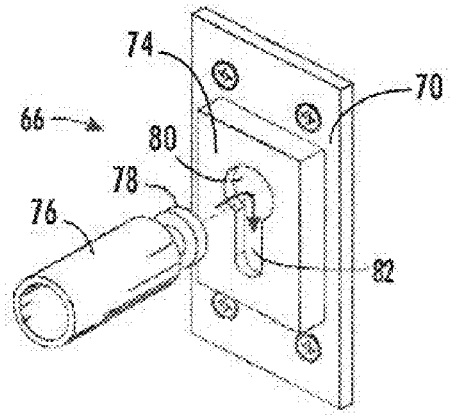
FIG. 5A is a perspective view of an angle bracket.
Figure 5B:
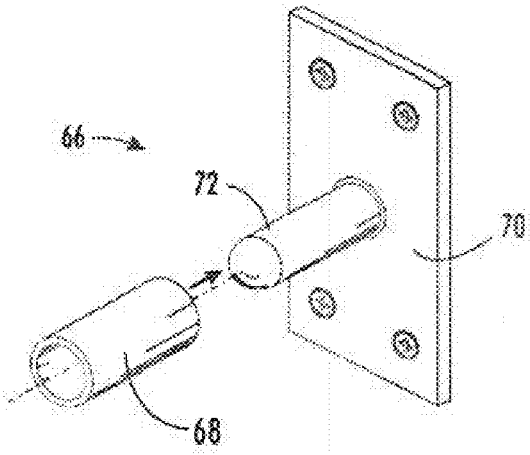
FIG. 5B is a perspective view of a keyhole bracket.

Referring to FIGS. 1, 2, 5A, 5B, and 5*c*, at least four bracket members 66 are mounted to the outer perimeter of the window frame. By "outer perimeter of the window," it is meant that the bracket members 66 can be mounted to the actual window frame or to the building itself provided that the bracket members 66 are proximal to the window frame and hence window. The bracket members 66 are preferably fabricated from metal or durable plastic. To secure the bracket members 66 to the outer perimeter of the window 12, drilling or boring of screw or nail holes through the bracket and the window frame is preferably. In one configuration, at least four screws are placed in four screw holes drilled in each of the bracket members 66. Alternatively, the bracket members 66 can be adhered to the surface of the outer perimeter of the windows, provided that a strong adhesive is utilized. For a square or rectangular window, a bracket member 66 is mounted proximate to each corner of the window 12 or corner of the opening frame 84. Preferably, each bracket member 66 is similarly oriented when mounted and suitably sized to receive a coupler, such as a hollow pole extension 68. That is, in one configuration, as shown in FIG. 5B, each bracket member 66 comprises a flat plate 70 and a protruding member 72, typically centrally located. Each protruding member 72 is perpendicular to each flat plate 70, such that when the bracket members 66 are mounted, each protruding member 72 is substantially parallel to a ground surface. Each protruding member 72 receives the hollow pole extension 68 which spaces the base 22 at least four inches, more preferably six inches and even more preferably eight inches, from the planar surface of the window 12. The hollow pole extensions 68 are coupled to the base 22 and the substantially pyramidal-shaped enclosure 20 via connectors 30. The connectors 30 can be made of any impact resistant material, including but not limited to metal, fiberglass, stainless steel, aluminum, rubber, plastic, high durometer plastic, etc.

In another configuration, the bracket members 66 can comprise keyhole brackets 74 as shown in FIG. 5A. In this configuration, each knobbed terminal end 78 of an extension 76 engages a mouth 80 of each keyhole bracket 74 and slides into a slot 82 to secure the extension 76 in a temporarily fixed position. The extensions 68, 76, or 91 are coupled to the base 22 and the substantially pyramidal-shaped enclosure 20 via connectors 30.

Figure 5C:
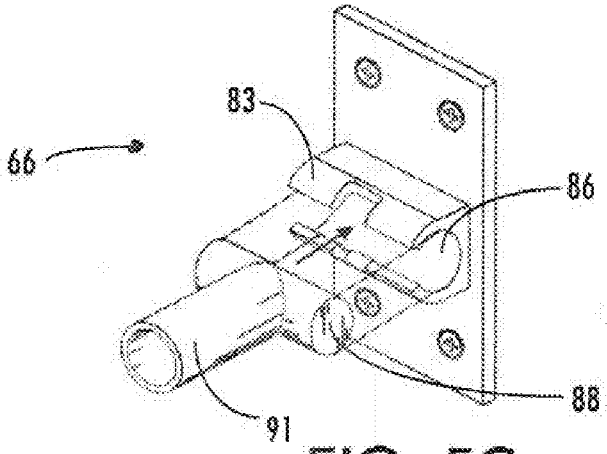
FIG. 5C is a perspective view of an angle clinch bracket.
Figure 6:
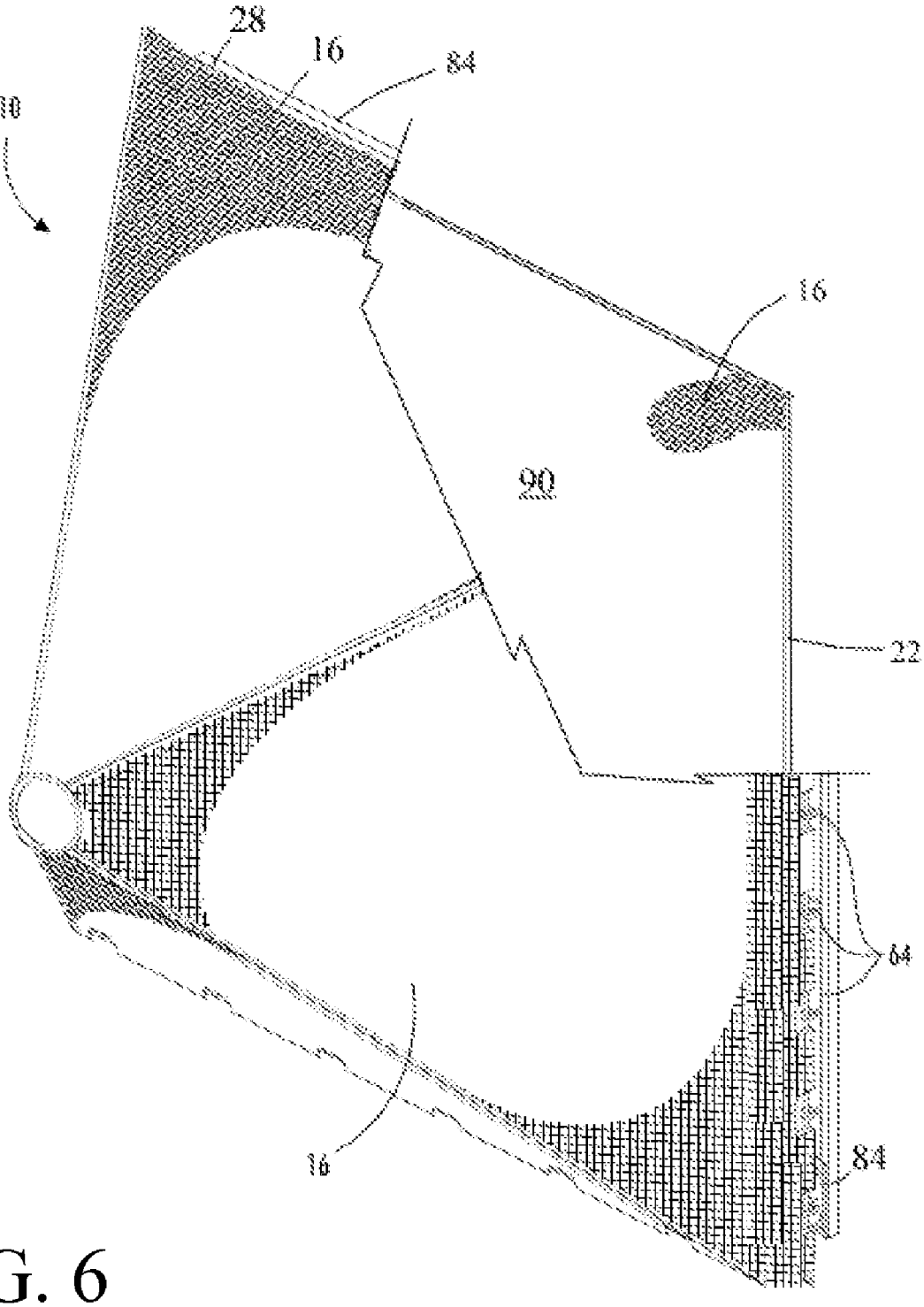
FIG. 6 is a perspective view of the window barrier with a partial cut away.
Figure 7:
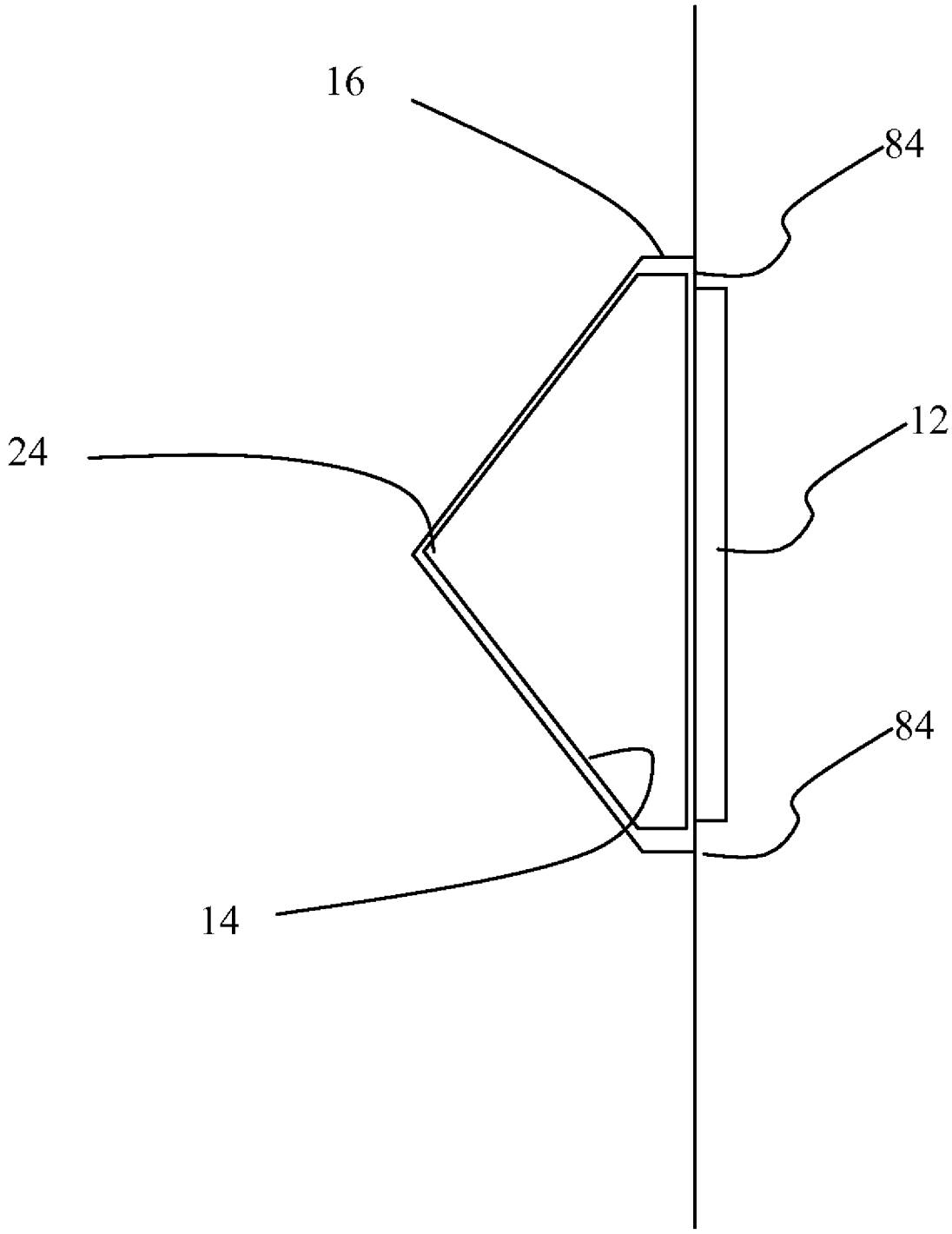
FIG. 7 is a schematic cross sectional view of the window barrier.

In yet another configuration, as shown in FIG. 5C, the bracket members 66 can comprise an angle clinch bracket 83 which includes a socket 86 for receiving a rounded terminal end 88 of an extension 91. The angle clinch bracket 83 is preferably fabricated of a stiff elastomeric material, allowing the bracket 83 to flex enough to receive and secure the rounded terminal end 88 of the extension 91 in the socket 86.

A person having ordinary skill in the art would be able to use a variety of bracket member types, which include but are not limited to stamped metal brackets, L-shaped brackets, cast aluminum brackets, stainless steel and chrome brackets, nylon brackets, etc.

In use, the bracket members 66 and the unshaped mounts 64 are attached to the outer perimeter of the window 12, and typically to the opening frame 84 then, the pole extensions 68 are coupled to protruding ends of the bracket members 66. An individual forms the aerodynamic shaped frame 14 about a portion of the window 12 by coupling the rectangular-shaped base 22 to the connectors 30 positioned on the hollow pole extensions 68 and coupling the pyramidal-shaped enclosure 20 to the connectors 30. In an embodiment of the invention, the pyramidal-shaped enclosure 20 comprises an automatic deployment system, wherein the flexible joint 26 and struts 18*a* are pre-coupled during manufacture reducing the installation time required by the installer. In one configuration, a portion of the flexible material 16 is fastened to the opening frame 84 by disposing the flexible material 16 over the frame 14 and securing the clips 62 to the u-shaped mounts 64. The frame 14 and flexible material 16, therefore, reduce a wind drag coefficient on the window 12. The frame 14 and the flexible material 16 define the enclosed volume 90, wherein the base 22 is adjacent to the plane of the window 12, or alternatively the base 22 is spaced from the plane of the window and the peripheral skirt of flexible material is drawn adjacent the opening frame.

The frame 14, the flexible material 16 and any brackets, couplers and connectors are selected to dispose the edge of the flexible material, and in selected configurations the base of the enclosed volume 90 adjacent the opening frame 84. Thus, upon air passing through the flexible material 16 into the enclosed volume 90 increases the pressure within the enclosed volume, thus the pressure in the enclosed volume becomes greater than the surrounding ambient pressure. The increased pressure in the enclosed volume 90 acts on the inside of the flexible material 16 and increases the resistance of the flexible material 16 to impacts. In response to the impacting wind experienced during a storm, the window barrier 10 forms a volume of air within the volume 90 having a pressure that is greater than ambient air pressure. The contained volume 90 of increased air pressure (greater than ambient pressure) provides increased resistance to debris impact damage than a partially enclosed volume which experiences only ambient air pressure.

In alternative configurations, the frame 14 or coupler which is connected to the frame is engaged with a corresponding bracket on the opening frame 84, thereby securing the frame 14 to the opening frame. As previously described, the flexible material 16 is disposed about the frame 14, enclosing enclosure 20 and forming volume 90, wherein a portion of the material is then connected to the opening frame to be adjacent to or abut the opening frame.

Although the present invention has been described in terms of particular embodiments, it is not limited to these embodiments. Alternative embodiments, configurations or modifications which will be encompassed by the invention can be made by those skilled in the embodiments, configurations, modifications or equivalents may be included in the spirit and scope of the invention, as defined by the appended claims.

The invention claimed is:

1. A weather barrier assembly for an opening frame having an outer perimeter and a frangible element within the perimeter of the opening frame, the weather barrier assembly comprising:

a plurality of struts forming a frame having a converging end and a diverging end, the diverging end having a given periphery;

a plurality of brackets disposed about the opening frame, the diverging end of the frame engageable with the brackets to space the converging end from the frangible element; and a flexible material enclosing the converging end and the diverging end of the frame to define an enclosed volume.

2. The weather barrier assembly of claim 1, wherein the frame includes a base at the diverging end, the base having a plurality of coplanar struts defining the given periphery.

3. The weather barrier assembly of claim 2, wherein the base is spaced from the frangible element.

4. The weather barrier assembly of claim 2, wherein the base includes adjustable length struts.

5. The weather barrier assembly of claim 2, further comprising a coupler attached to each bracket and interconnecting the respective bracket to the frame.

6. The weather barrier assembly of claim 4, further comprising a plurality of connectors, wherein one of the plurality of connectors couples one of the adjustable length struts to another one of the adjustable length struts.

7. The weather barrier assembly of claim 1, wherein the flexible material extends from adjacent the frangible element to the converging end.

8. The weather barrier assembly of claim 1, wherein the flexible material has an air permeability between approximately 6 cubic feet per minute and 21 cubic feet per minute.

9. The weather barrier assembly of claim 1, wherein a portion of the enclosed volume is adjacent to the frangible element.

10. The weather barrier assembly of claim 1, wherein the flexible material includes a hem along the outer circumference, the hem arranged to receive a cable therein.

11. The weather barrier assembly of claim 10, wherein the cable is exposed at predetermined positions, and wherein a plurality of clips is attached to the cable at the exposed predetermined positions to dispose the cable within three inches of a plane of the opening frame.

12. The weather barrier assembly of claim 11, further comprising a plurality of mounts disposed along the opening frame, wherein one of the plurality of clips fastens to one of the mounts.

13. The weather barrier assembly of claim 12, wherein the mounts are U-shaped.

14. The weather barrier assembly of claim 11, further comprising a thread coupled to the cable and the flexible material, the thread having a tensile strength that is less than a tensile strength of the flexible material.

15. A weather barrier assembly for protecting a frangible element of a building surrounded by an opening frame, the assembly comprising:

a plurality of brackets and mounts disposed outside a periphery of the frangible element;

a frame including at least four struts each having one end at a frame converging end and a second end at a frame diverging end, the frame converging end distal from the frangible element and the frame diverging end coupled to one of the plurality of brackets; and a flexible material enclosing the converging end and the diverging end of the frame to define an enclosed volume.

16. The weather barrier assembly of claim 15, wherein the frame includes a base at the diverging end, the base having a plurality of coplanar struts, the flexible material enclosing the frame.

17. The weather barrier assembly for protecting a frangible element of a building surrounded by an opening frame, the assembly comprising:

a plurality of brackets and mounts disposed outside a periphery of the frangible element;

a frame including at least four struts each having one end at a frame converging end and a second end at a frame diverging end, the frame converging end distal from the frangible element and the frame diverging end coupled to one of the plurality of brackets;

base at the frame diverging end, the base having a plurality of coplanar adjustable length struts; and a flexible material enclosing the frame to define an enclosed volume.

18. A method of isolating a frangible element of a building from weather comprising:

attaching a frame having a diverging end and a converging end to a corresponding bracket on a opening frame surrounding the frangible element; and fastening a flexible material to the frame to enclose the converging end and the diverging end of the frame to define an enclosed volume.

* * * * *